US005300737A

United States Patent [19]

Nakanishi

[11] Patent Number: 5,300,737

[45] Date of Patent: Apr. 5, 1994

[54] TUBULAR LINEAR MOTOR DRIVEN ELEVATOR

[75] Inventor: Yoshinori Nakanishi, Kawasaki, Japan

[73] Assignee: Otis Elevator Company, Farmington, Conn.

[21] Appl. No.: 856,777

[22] Filed: Mar. 24, 1992

[30] Foreign Application Priority Data

Mar. 25, 1991 [JP] Japan ..... 3-17872[U]

[51] Int. Cl.[5] ..... B66B 11/04

[52] U.S. Cl. ..... 187/112; 187/94

[58] Field of Search ..... 187/77, 80, 81, 86, 187/94, 108, 112, 122, 135

[56] References Cited

U.S. PATENT DOCUMENTS 4,402,386 9/1983 Ficheux et al. ..... 187/94
5,014,828 5/1991 Baldassarre ..... 187/86
5,033,588 7/1991 Nakai et al. ..... 187/112
5,036,955 6/1991 Nakai et al. ..... 187/107
5,090,516 2/1992 Grinaski et al. ..... 187/112
5,203,432 4/1993 Grinaski ..... 187/94

FOREIGN PATENT DOCUMENTS 2-310278 12/1990 Japan ..... 187/112

*Primary Examiner*—Steven L. Stephan
*Assistant Examiner*—Thomas M. Dougherty
*Attorney, Agent, or Firm*—Lloyd D. Doigan

[57] ABSTRACT

A linear motor driven elevator comprises: a cab capable of upward and downward movement; a linear motor comprising a movable element and a stationary element; a counterweight attached to the movable element such that the movable element is disposed thereon out of register with the center of gravity of the counterweight; and a rope connecting the cab and the counterweight at the center of gravity of the counterweight.

9 Claims, 2 Drawing Sheets

TUBULAR LINEAR MOTOR DRIVEN ELEVATOR

TECHNICAL FIELD

This invention relates to a tubular linear motor driven elevator.

BACKGROUND OF THE INVENTION

A conventional linear motor type elevator is shown in FIG. 4. Cab 101 is powered upwardly and downwardly in a building by means of a linear motor 102. The linear motor 102 comprises a movable element 103 having an axial hole through which a rod-shaped stationary element 104 passes. A frame 107 houses weights 105 and 106 at both sides of the movable element 103. The frame, the weights and the movable element form a counterweight for balancing the weight of the cab 101.

Ropes pairs 108*a*, 108*b* and 109*a*, 109*b*, attach at one end thereof to either side of the stationary element at the upper end of the frame, pass over sheaves 110*a*, 110*b* 111*a*, 111*b* and attach at a second end thereof to the top of the cab.

If ropes 108*a*, 108*b*, 109*a*, 109*b* are somehow severed, two buffers 112, 113 are provided at both sides at the lower end side of the movable element 104 to prevent the frame, movable element and weights from colliding with the floor of the building.

DISCLOSURE OF THE INVENTION

It is an object of the present invention to provide a linear motor driven elevator in which the number of ropes, sheaves, buffers and the like are minimized.

According to the invention a tubular linear motor driven elevator comprises: a cab capable of upward and downward movement; a linear motor comprising a movable element and a stationary element; a counterweight including the movable element, the movable element being disposed on the counterweight out of register with a center of gravity of the counterweight; and a plurality of ropes connecting the cab to the counterweight at the center of gravity of the upper surface of the counterweight.

By moving the linear motor out of register with the center of gravity of the counterweight, the ropes can be attached to the counterweight at the center of gravity of the upper surface of the counterweight. As a result, the number of ropes, sheaves, and buffers may be minimized.

The ropes may be reduced to one set of three ropes as opposed to two sets of two ropes. Further, one set of ropes requires only two sheaves as opposed to four in the prior art. Finally, a single buffer may be provided at the center of gravity of the counterweight without interfering with the stationary element, so that the pair of buffers required by the prior art are no longer necessary.

These and other objects, features, and advantages of the present invention will become more apparent in light of the following detailed description of a best mode embodiment thereof, as illustrated in the accompanying drawing.

BEST MODE FOR CARRYING OUT THE INVENTION

Figure 1:
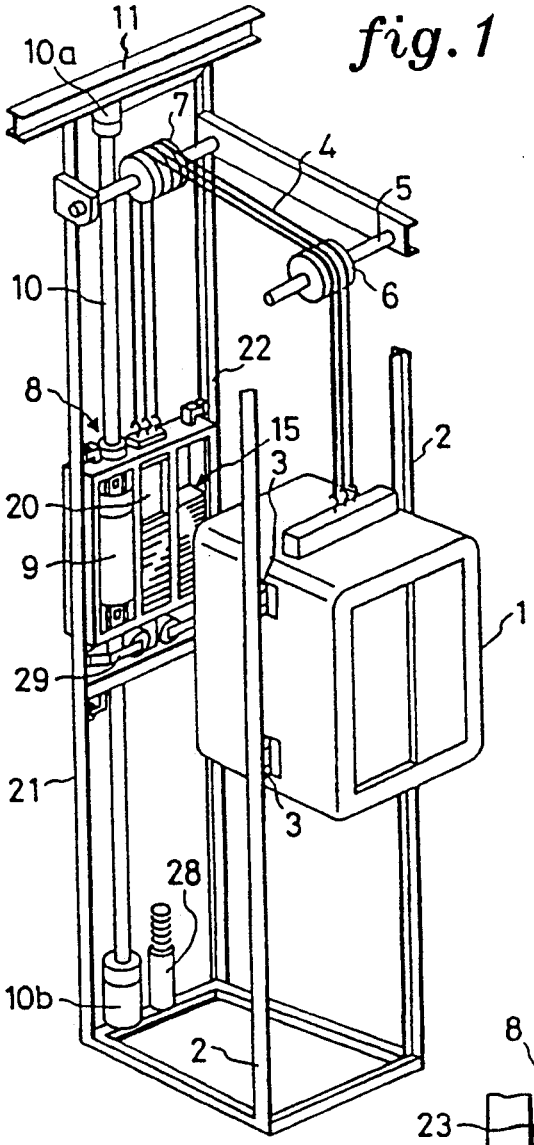
FIG. 1 is a perspective view showing an example of the linear motor driven elevator of the present invention.
Figure 2:
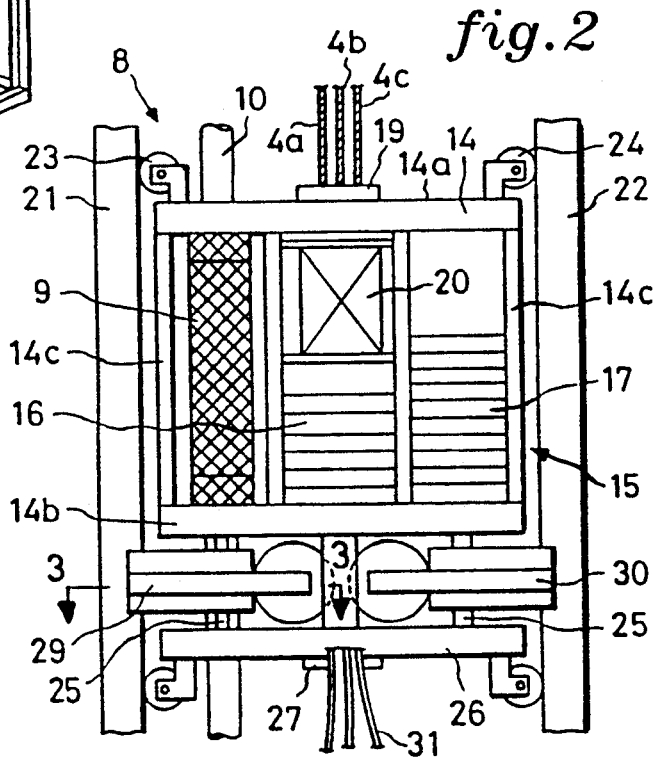
FIG. 2 is a front view of the movable element and the counterweight.
Figure 3:
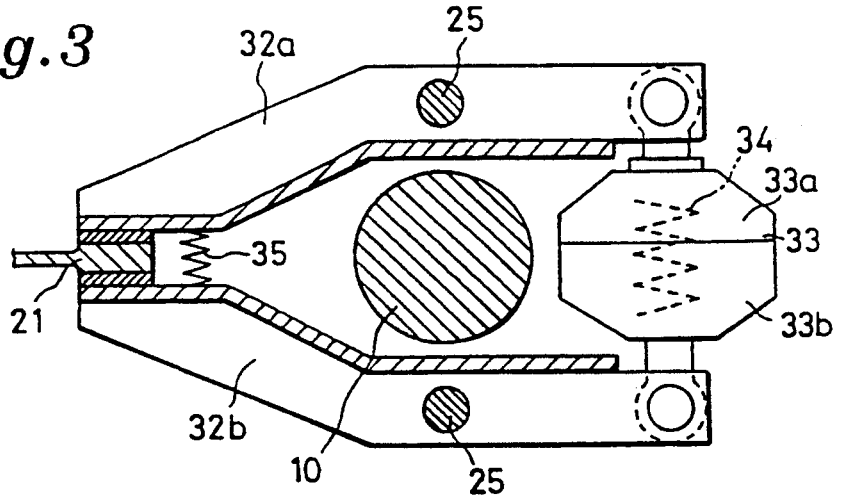
FIG. 3 is a cross-sectional view taken along the line A—A in FIG. 2.
Figure 4:
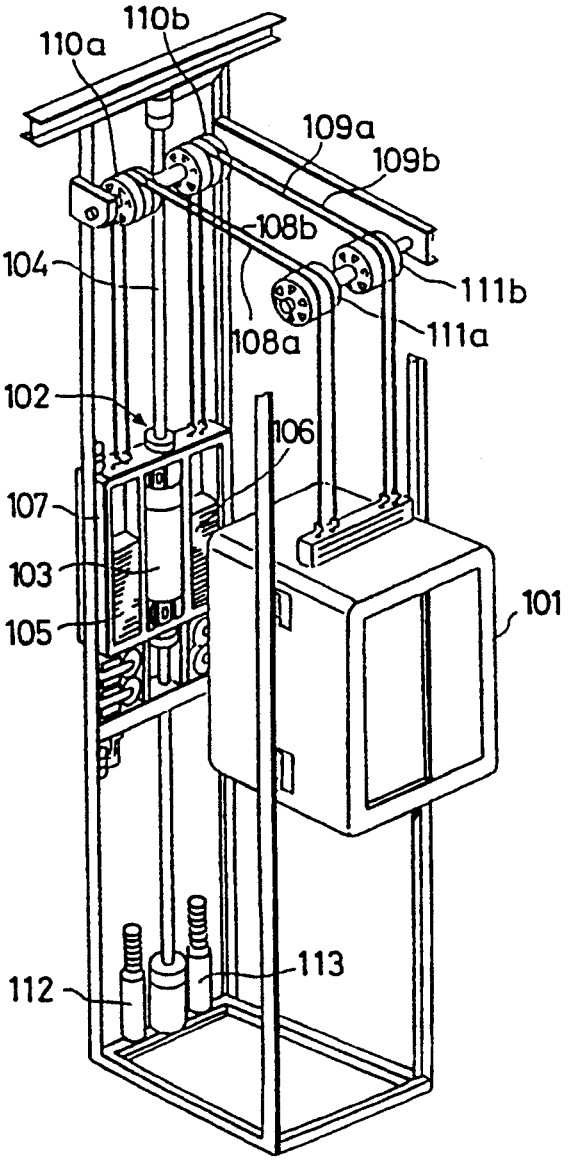
FIG. 4 is a perspective view of a linear motor driven elevator of the prior art.

Referring to FIGS. 1-3, a best mode embodiment of a linear motor driven elevator according to the present is shown.

Referring to FIG. 1, cab 1 is disposed in a building in a manner capable of upward and downward movement. Guide rails extend at both sides of the cab 1, as is known in the art, to guide the cab upwardly and downwardly via sliding roller members 3 attached to the cab.

One set of three ropes 4*a*, 4*b*, 4*c* is attached to the center of an upper wall of the cab 1, guided by sheave 6 rotating about a first support shaft 5, guided by sheave 7 rotating about a second support shaft, and secured to a counterweight 15 as will be discussed infra.

The linear motor 8 comprises a movable element 9 having an axial hole through which a stationary element 10 passes. The stationary element 10 extends a length of the building, has a top portion which is fixed to a support 11 via connector 10*a*, and has a bottom portion which is fixed to a stationary member 12 via support 10*b*.

Referring to FIG. 2, the counterweight 15 comprises frame 14, weights 16 and 17, and movable element 9. The frame 14 is guided upwardly and downwardly along rails 21, 22 by sliding roller members 23, 24. Movable element 9 is attached to the left side of the frame. Weights 17 are placed between upper and lower plate members 14*a*, 14*b* and column members 14*c* provided between the upper and lower plate members 14*a*, 14*b* on the right side of the counterweight to balance the weight of the movable element. Filler weights 16 are added as necessary so that the entire weight of the counterweight balances the weight of the cab 1. The weight of the counterweight 15 including the movable element 9 is about 1.5 times the weight of the cab 1.

As described above, the movable element 9 is located at the left side rather than the center of the frame 14, so that ropes 4*a*, 4*b*, 4*c* may be connected to the center of gravity of the counterweight 15 (via hitch plate 19) without interfering with the stationary element 10.

An electrical junction box 20 is provided under the upper plate member 14*a*. Traveling cable 31 supplies electricity for movable element 9 via junction box 20 as is known in the art.

A buffer plate 26 is attached to the lower plate member 14*b* of the frame by means of pairs of shafts 25. The buffer plate 26 has a hydraulic buffer device 27 under which is provided a buffer 28 (see FIG. 1). Buffer 28 is positioned under the center of gravity of the buffer plate 26 without interfering with the stationary element 10. As described above, the buffer 28 can be provided under the center position of the buffer plate 26, so that a pair of buffers is unnecessary.

Each pair of support shafts 25 is provided with a braking device 29 or 30. As shown in FIG. 3, at both sides of the stationary element 10 a pair of brake arms 32*a*, 32*b* are supported by the support shafts 25 in a freely rotating manner. An electromagnetic brake 33 is disposed between the proximal end of the brake arms 32*a*, 32*b*. The electromagnetic brake 33 comprises an armature 33*a*, a brake coil 33*b* for attracting the armature, and a brake spring 34 disposed between the armature 33*a* and the brake coil 33*b*. The distal ends of the brake arms 32*a*, 32*b* clamp a rail 21 via linings. A spring 35 is provided between the distal ends. The armature 33*a* of the electromagnetic brake 33 is attracted by the brake coil 33 during application of current. The attraction dissipates if a power outage occurs and the brake arms 32*a*, 32*b* clamp the rail 21 by means of the force of the brake spring 34 to stop the movable element 9 and the cab 1.

Although, the invention has been shown and described with respect to a best mode embodiment thereof, it should be understood by those of ordinary skill in the art, that various omission, changes and additions in the form and detail thereof may be made without departing from the spirit and scope of the invention.

We claim:

1. A tubular linear motor driven elevator comprising:
a cab,
a counterweight having a center of gravity and a top portion,
a linear motor comprising a movable element and a stationary element, said movable element disposed within said counterweight and forming a portion thereof, said moveable element disposed out of register with said center of gravity, said stationary element passing through said counterweight and through said moveable element out of register with said center of gravity, and
a rope attaching at a first end thereof to said cab and at a second end thereof attaching to said counterweight at a center of gravity of said top portion.

2. The linear motor driven elevator of claim 1 further comprising:
a buffer disposed beneath and in register with said center of gravity of said counterweight.

3. A linear motor driven elevator comprising:
a cab,
a counterweight,
a linear motor comprising a tubular movable element and a stationary element, said movable element disposed within said counterweight and forming a portion thereof, said moveable element disposed out of register with said center of gravity, said stationary element passing through said counterweight and through said moveable element out of register with said center of gravity, and
a rope attaching at a first end thereof to said cab and at a second end thereof attaching to said counterweight at a center of gravity of said top portion.

4. The linear motor driven elevator of claim 3 further comprising:
a buffer disposed beneath and in register with said center of gravity of said counterweight.

5. The linear motor driven elevator of claim 9 further comprising:
a braking surface, and
a brake disposed upon said counterweight for cooperating with said braking surface to stop motion of said counterweight, said brake having a first arm for contacting said surface and a second arm for contacting said surface, said first arm disposed on a first side of said stationary element and said second arm being disposed on a second side of said stationary element.

6. The linear motor driven elevator of claim 5 further comprising:
a buffer disposed beneath and in register with said center of gravity of said counterweight.

7. A tubular linear motor driven elevator comprising:
a cab,
a linear motor having a movable portion and a stationary portion,
a frame disposed within a plane and having a center of gravity and a top portion, said movable portion being disposed within said frame and within said plane out of register with said center of gravity within said plane, said stationary portion passing through said frame and said moveable portion, said frame and said moveable portion forming a counterweight,
a rope attaching at a first end thereof to said cab and at a second end thereof to a center of gravity of said top portion.

8. A tubular linear motor of claim 7 further comprising:
a plurality of weights disposed within said frame.

9. The tubular linear motor driven elevator of claim 7 further comprising:
a buffer disposed beneath and in register with said center of gravity of said counterweight.

* * * * *